United States Patent [19]
Kramis et al.
[11] 4,317,660
[45] Mar. 2, 1982

[54] MANUFACTURING OF FLEXIBLE ABRASIVES

[75] Inventors: Jost Kramis, Islikon; Jakob Ackermann, Wigoltingen, both of Switzerland

[73] Assignee: SIA Schweizer Schmirgel-und Schleif-Industrie AG, Frauenfeld, Switzerland

[21] Appl. No.: 144,593

[22] Filed: Apr. 28, 1980

[30] Foreign Application Priority Data

May 4, 1979 [DE] Fed. Rep. of Germany ..... 2918103

[51] Int. Cl.[3] ..... B24D 11/00
[52] U.S. Cl. ..... 51/295; 51/262 R; 51/298; 51/310; 118/213; 427/282
[58] Field of Search ..... 51/295, 297, 298, 262, 51/310; 118/213; 427/197, 199, 282

[56] References Cited

U.S. PATENT DOCUMENTS

| | | | |
|---|---|---|---|
| 3,093,462 | 6/1963 | Rapoport | 427/197 |
| 3,432,328 | 3/1969 | Vaurio | 427/282 |
| 3,605,349 | 9/1971 | Anthon | 51/295 |
| 3,906,684 | 9/1975 | Marshall et al. | 51/295 |
| 3,925,586 | 12/1975 | Maxwell | 427/282 |
| 3,951,714 | 4/1976 | Franco | 427/282 |
| 3,991,527 | 11/1976 | Maran | 51/397 |
| 4,018,956 | 4/1977 | Casey | 427/197 |
| 4,076,567 | 2/1978 | Yoshikawa et al. | 427/282 |
| 4,135,020 | 1/1979 | Maxwell | 427/282 |

*Primary Examiner*—Donald E. Czaja
*Assistant Examiner*—W. Thompson
*Attorney, Agent, or Firm*—Brooks, Haidt, Haffner & Delahunty

[57] ABSTRACT

Abrasive grains are bound to a flexible support by a pattern of resin applied by means of a curved stencil having a wall thickness of 0.08 to 1 mm and having holes with a diameter of 0.05 to 3 mm, the total hole area amounting to 5 to 50% of the area of the stencil. A top binding agent is applied before or after the drying or hardening of the resin.

11 Claims, No Drawings

MANUFACTURING OF FLEXIBLE ABRASIVES

The invention relates to flexible abrasives with a pattern of a base binding agent imprint by means of a stencil, and abrasive grains, on a flexible support, and a method for their manufacture.

The cutting power of abrasives and the surface quality which is obtained alter with the degree of wear, particularly in the case of abrasives on a flexible support in a grinding tool. The peak-to-valley height is reduced and these abrasives become increasingly blunter during use, until the grinding tool has to be replaced owing to inadequate cutting power. In order to improve abrasives on flexible supports, it has been suggested that the base binding agent and the abrasive grains be applied to the flexible support in the form of geometrically arranged patterns.

Fibre discs with geometrically arranged patterns are disclosed in U.S. Pat. No. 3,991,527. The patterns comprise a binding agent and abrasive grains and are traversed by zones or channels which are free from binding agent and grains. The binding agent is applied to the disc-shaped support by means of a roll whose surface having annular recesses or recesses extending over the periphery, thus producing corresponding annular elevations or elevations extending over the periphery. Coating with this roll produces binding agent areas on the support which are traversed by channels which are free from binding agent, the surface of the coated areas being disposed parallel to the surface of the uncoated channels, i.e. the surface of the binding agent areas and the surface of the support lying in parallel planes, and the channels adjacent to the binding agent areas having a rectangular cross-section.

German Specification (Offenlegungsschrift) No. 26 50 942 refers to the manufacture of flexible abrasives comprising geometrically arranged patterns of binding agent and abrasive grains on a flexible support, these patterns being obtained by providing the support with elevations and/or recesses in a geometrically defined arrangement such that this geometrical arrangement of the support is transferred to the position, particularly the vertical position, of the scattered abrasive grains. The elevations and recesses in the support frequently have an undulatory shape. German Specification (Offenlegungsschrift) No. 22 56 079 describes a method of manufacturing an abrasive foil of a plastics material with an enriched abrasive (particularly diamond powder) which is pressed into and uniformly distributed over the surface, to grind cutting styluses and sensors for information carriers, the surface of the plastics foil being uniformly provided with recesses to accommodate the abrasive and, after having been filled with the abrasive, being thermoplastically shaped by a stamping operation such that the surface is levelled and the abrasive is bound in the upper layer.

What is desired is an abrasive, comprising abrasive grains on a support, having an extended service life with minimal alteration of the peak-to-valley height and without necessitating the use of increased quantities of abrasive grains and binding agent.

It is also desired to use the abrasive grains more efficiently than was previously the case, i.e. to restrict the abrasive grains to certain effective areas.

The present invention provides a flexible abrasive having a geometrically arranged pattern of a base binding agent imprinted by means of a stencil, abrasive grains, and a top binding agent, on a flexible support, in which by means of a curved stencil, the basic binding agent is applied with an inner doctor blade, the wall thickness of the stencil is between 0.08 and 1 mm, the stencil is provided with holes having a diameter of 0.05 to 3 mm, and the area of all the holes is between 5 and 50% of the area of the stencil.

The preferred stencil is cylindrical and has a wall thickness of 0.1 to 0.25 mm, the holes having a diameter of 0.05 to 3 mm and their total area covering 5 to 35% of the entire area of the stencil. The screen-like structure of the stencil is not restricted to circular holes; for example, the stencil cavities can have a rectangular, square, or triangular shape, and the details concerning the diameter then refer to the diameter of a circle described about the shape of a hole.

The preferred stencil can be compared to the curved stencils which are used for screen printing and which are known from printing technology. They are shaped like a cylinder jacket provided with grid-like holes and horizontally secured in a rotatable manner to e.g. two points of the axis of rotation. The support for the abrasive grains makes line contact with the screen-printing stencil, by means of which the base binding agent is applied. During this continuous operation the support is unrolled from a roll, for example, and guided at a uniform speed past the stencil which contacts it, and it is possible to synchronise the rotational speed of the stencil and the speed of the support. By means of a doctor blade, which is disposed inside the cylindrical stencil and is preferably rigidly secured, the binding agent which is fed into the stencil is pressed out through the stencil holes spaced along the line of contact with the support. The width of the stencil is adapted to the width of the abrasive path.

The abrasive grains can be spread onto an imprinted resin pattern which still has a bonding capacity, the resin (binding agent) subsequently being dried and/or hardened. According to the type of resin which is used and depending on suitability, the top binding agent can be applied before of after drying and/or hardening of the base binding agent.

Preferably, the holes of the stencil have a diameter of 0.06 to 1 mm. This enables particularly fine base binding agent screens to be obtained.

It is preferable for the size of the individual imprinted points of the base binding agent to be related to the mean diameter of the abrasive grains such that the respective abrasive grains which are applied to adjacent individual points just contact each other or, at most, are disposed at a spacing with respect to each other which is smaller than half the mean grain diameter of the abrasive grains. It is particularly preferable for the relationship to be such that the abrasive grains which are applied to adjacent individual points just contact each other or, at most, are disposed at a spacing with respect to each other which is smaller than approximately $\frac{1}{3}$ of the mean grain diameter of the abrasive grains.

The mean diameter of the abrasive grains may conveniently be 75 to 750 microns, preferably 125 to 500 microns.

The method according to the invention is basically different from that described in U.S. Pat. No. 3,991,527. Owing to the preferred use of a curved stencil with an inner doctor blade, the surface of the coated pattern does not lie in a plane which is parallel to the surface of the support, but rather has the shape of hemispheres in the case of a curved stencil with round holes, so that the abrasive grains which are spread over the pattern are also disposed in the shape of hemispheres, as a result of which abrasive belts manufactured according to this method have long service lives and the peak-to-valley height only undergoes a slight change.

The use of a stencil for applying the base binding agent—this method not consisting in uniform application of resin to the flexible support, as has been usual for decades—has the surprising result of producing a perfect flexible abrasive, particularly a flexible abrasive belt, for e.g. smoothing wood or other materials, which are inclined to clog the abrasive surface.

Surprisingly good performance is obtained during grinding, even though the method according to the invention offers possibilities of economising on base binding agent and abrasive grains.

The base binding agent may be applied to the flexible support, with a doctor blade, by means of stencils such as, for example, screen printing stencils or curved stencils with corresponding grid-like, geometrically arranged hole patterns. Suitable stencils can be obtained, for example, from the firm K. Iten AG, CH-8964 Rudolfstetten, Switzerland. The stencils are preferably manufactured from metal and a rubber doctor blade is preferably used.

The base binding agent can be applied continuously or intermittently. When the curved stencil is in use the resin or other binding agent is continuously fed into the stencil and scraped through the recesses of the stencil onto the flexible support by means of the doctor blade.

The base binding agent is preferably applied to a support, which is somewhat flexible, such as paper, textile fabric and combinations of textile fabric and paper, fibre, or foil.

Suitable base binding agents, which is applied to the flexible support by using a stencil, preferably a curved stencil with an inner doctor blade, are conventional resins, such as, for example, hide glues, glutin glues, and urea formaldehyde, phenol formaldehyde, and epoxy resins. It is also possible, in a manner which is known per se, for other substances, e.g. fillers such as chalk, kaolin, or thickening substances such as highly dispersed silicic acids and bentonite, to be added to these resins.

Conventional abrasive grains of natural or synthetic materials may be gravimetrically spread or applied in an electrostatic manner to a grid-like, geometrically arranged base binding agent pattern, while it still has a binding capacity or is able to bind abrasive grains. The grains which are used are, for example, those of corundum, zirconium corundum, spinel corundum, silicon carbide, boron carbide, boron nitride, diamond, ruby, flint, emery, or mixtures of these abrasive grains. The base binding agent pattern can also be used with abrasive grain agglomerates or abrasive grains which are manufactured in various manners which are known per se.

Following the application of the abrasive grains to the base binding agent, which is applied to the flexible support by means of the stencil, the abrasive which is thus produced may be dried and/or hardened. Subsequent to this fixation of the grains by drying and/or hardening of the base binding agent, a second layer of binding agent, the so-called top layer of binding agent, is applied to provide better embedment and fixation of the grain. This second layer is applied in the usual manner, after which it is also dried and/or hardened in the usual manner.

EXAMPLE 1

A base binding agent was applied in the form of a grid to an abrasive paper weighing 230 g per $m^2$ by means of a curved stencil with an inner doctor blade. The base binding agent was produced by mixing in a dissolver 200 parts of a phenol resol (solid-state body:70%, viscosity:800 mPa s), 7 parts of chalk powder, and one part of a highly dispersed silicic acid (Aerosil 200 of Degussa AG). The curved stencil had a width of 400 mm, a diameter of 204 mm, and a wall thickness of 0.22 mm. The circular holes of the stencil had a diameter of 0.45 mm and covered, in a regular arrangement, 18% of the stencil surface.

The resin pattern produced, while still having a bonding capacity, was scattered with corundum (97% $Al_2O_3$) of grain size P60 (FEPA standard) in an electrostatic field and dried in a through-circulation oven for 20 minutes at a temperature rising from 80° C. to 120° C. A top binding agent, produced in a dissolver from 50 parts of a phenol resol (solid-state body:71%, viscosity:1000 mPa s), 35 parts of a chalk powder, and 4 parts of water, was applied with a rubber roller and dried and hardened in the oven for 4 hours at a temperature rising from 70° C. to 120° C.

The abrasive which, produced is suitable as an abrasive belt, particularly for smoothing wood, the belt clogging only slightly even after prolonged use and particularly having a high abrasive performance and efficiency.

EXAMPLE 2

The base binding agent of Example 1 was applied in the manner of a grid to a finished abrasive textile fabric of average flexibility by means of a curved stencil with an inner doctor blade and scattered with corundum P36 (FEPA standard).

A stencil similar to that of Example 1 was used, but with circular holes having a diameter of 1 mm and covering 25% of the stencil area. A second binding agent layer of a phenol single-stage resin filled with chalk was also applied, dried, and hardened for a better fixation of the grains.

Abrasive belts produced in this way have given satisfactory results in metal surface grinding and the belts are in particular comparatively less inclined to clog when grinding aluminum, while the relatively constant abrasive performance during the entire grinding period when grinding steel is particularly striking.

We claim:

1. A method of manufacturing a flexible abrasive, comprising the steps of applying a pattern of a base binding agent to a flexible support by means of a stencil, and binding abrasive grains to the support by means of the base binding agent, the stencil having a wall thickness of 0.08 to 1 mm and having holes with a diameter of 0.05 to 3 mm, the total area of the holes amounting to 5 to 50% of the area of the stencil.

2. A method as claimed in claim 1, in which the base binding agent is applied through a curved stencil by means of a doctor blade.

3. A method as claimed in claim 1, including spreading abrasive grains on the pattern while the base bonding agent has bonding capacity, and then drying or hardening the base bonding agent.

4. A method as claimed in claim 1, in which the wall thickness of the stencil is 0.1 to 0.25 mm.

5. A method as claimed in claim 1, in which the diameter of the holes is 0.06 to 1 mm.

6. A method as claimed in claim 1, in which the holes are circular.

7. A method as claimed in claim 1, in which the abrasive grains on adjacent points of the pattern are spaced apart by less than half the mean grain diameter of the grains.

8. A method as claimed in claim 7, in which the said grains just contact each other.

9. A method as claimed in claim 1, in which the mean diameter of the abrasive grains is 75 to 750 microns.

10. A method as claimed in claim 9, in which the mean diameter is 125 to 500 microns.

11. A method as claimed in claim 1, further comprising applying a top binding agent to the support bearing the base binding agent and the abrasive grains.

* * * * *